US005591706A

United States Patent [19]

Ploumen

[11] Patent Number: 5,591,706

[45] Date of Patent: Jan. 7, 1997

[54] AQUEOUS PEROXIDE COMPOSITIONS WITH IMPROVED SAFETY PROFILE

[75] Inventor: Jan J. H. Ploumen, Roermond, Netherlands

[73] Assignee: Akzo Nobel N.V., Arnhem, Netherlands

[21] Appl. No.: 562,778

[22] Filed: Aug. 3, 1990

[30] Foreign Application Priority Data

Aug. 8, 1989 [EP] European Pat. Off. ..... 89202052

[51] Int. Cl.[6] ..... C11D 7/54

[52] U.S. Cl. ..... 510/372; 252/186.25; 252/186.26

[58] Field of Search ..... 252/95, 102, 104, 252/174.23, 186.25, 186.26

[56] References Cited

U.S. PATENT DOCUMENTS

| | | | |
|---|---|---|---|
| 3,507,800 | 4/1970 | Leveskis | 252/186.1 |
| 3,989,638 | 11/1976 | Bradley et al. | 252/186.1 |
| 3,996,152 | 12/1976 | Edwards et al. | 252/186.1 |
| 4,017,412 | 4/1977 | Bradley | 252/186 |
| 4,100,095 | 7/1978 | Hutchins et al. | 252/99 |
| 4,264,466 | 4/1981 | Carleton et al. | 252/95 |
| 4,634,551 | 1/1987 | Burns et al. | 252/102 |
| 4,642,198 | 2/1987 | Humphreys et al. | 252/94 |
| 4,681,592 | 7/1987 | Hardy et al. | 8/111 |
| 4,686,063 | 8/1987 | Burns | 252/95 |
| 4,758,369 | 7/1988 | Dyroff et al. | 252/94 |
| 4,790,949 | 12/1988 | Dankowski et al. | 252/95 |
| 4,909,953 | 3/1990 | Sadlowski et al. | 252/99 |
| 4,992,194 | 2/1991 | Liberati et al. | 252/99 |
| 5,004,558 | 4/1991 | Dyroff et al. | 252/95 |

FOREIGN PATENT DOCUMENTS

| | | |
|---|---|---|
| 0167375 | 1/1986 | European Pat. Off. . |
| 0176124 | 4/1986 | European Pat. Off. . |
| 0201958 | 11/1986 | European Pat. Off. . |
| 0240481 | 10/1987 | European Pat. Off. . |
| 0254331 | 1/1988 | European Pat. Off. . |
| 0283792 | 9/1988 | European Pat. Off. . |
| 0347988 | 12/1989 | European Pat. Off. . |
| 4614648 | 7/1992 | Japan . |
| 1387167 | 3/1975 | United Kingdom . |

*Primary Examiner*—Erin M. Harriman

*Attorney, Agent, or Firm*—Ralph J. Mancini; Louis A. Morris

[57] ABSTRACT

This disclosure relates to an aqueous peroxide composition with improved safety profile, the composition comprising a solid, substantially water-insoluble organic peroxy acid stably suspended in an aqueous medium, wherein the aqueous medium also comprises an effective amount of a safety booster selected from the group consisting of triethylene glycol, polyethylene glycol and mixtures thereof. The preferred organic peroxy acid is 1,12-diperoxydodeandioic acid. The aqueous peroxide composition is particularly useful in detergent, bleaching, cleaning and/or disinfecting formulations.

14 Claims, No Drawings

AQUEOUS PEROXIDE COMPOSITIONS WITH IMPROVED SAFETY PROFILE

The invention relates to an aqueous peroxide composition with improved safety profile, said composition comprised of a solid substantially water-insoluble organic peroxy acid stably suspended in an aqueous medium. The compositions of the current invention are particularly useful in bleaching formulations and may be used alone or in combination with other bleaches. Additionally, the current aqueous peroxide compositions may be included as part of detergent, cleaning and/or disinfecting formulations.

BACKGROUND OF THE INVENTION

Aqueous peroxide compositions and in particular the use of such compositions for laundering, bleaching, cleaning and/or disinfecting are well-known. For example, U.S. Pat. No. 4,642,198 discloses an aqueous liquid bleaching composition having a pH of from 1 to 6.5 comprised of 1 to 40 wt. % solid particulate substantially water-insoluble organic peroxy acid stably suspended in a surfactant structured liquid. European Patent Application 283 792 discloses storage-stable pourable aqueous bleach suspensions having a pH in the range of 1 to 6 and containing particulate water-insoluble peroxy carboxylic acid, xanthan gum or agars, hydratable neutral salt, optionally an acid for pH regulation, and aqueous liquid. European Patent Application 201 958 discloses pourable aqueous detergent and bleach compositions containing a linear alkyl benzene sulphonate, an ethoxylated fatty alcohol and an aliphatic peroxy dicarboxylic acid containing 8 to 13 carbon atoms wherein the pH of the composition is between 3.5 and 4.1. U.S. Pat. No. 3,996,152 describes a fabric bleaching composition having a viscosity in the range of 200 to 100,000 centipoise, the composition comprising a solid substantially water-insoluble peroxygen compound, a non-starch thickening agent, an acidifying agent to maintain the pH and a liquid carrier. U.S. Pat. No. 3,989,638 and 4,017,412 report fabric bleaching compositions comprised of certain substantially water-insoluble peroxygen compounds, a starch thickening agent and a liquid carrier.

Despite their usefulness in detergent, cleaning, disinfecting and bleaching formulations, a major difficulty remains in the use of aqueous suspensions of peroxy acids. As reported in European Patent Application 176 124 and in U.S. Pat. No. 4,790,949, dehydration of aqueous suspensions of peroxy acids produces a residue of solid peroxide particles. If such solid peroxide particles are not protected, desensitized or phlegmatised, there is a potential for ignitability and/or explosion if the residue is exposed to heat shock or abrasion. European Patent Application 176 124 reports that a pourable aqueous bleaching composition comprising a suspended peroxy carboxylic acid, 0.5 to 15 wt% of an alkali metal salt of an alkyl benzene sulphonic acid and 0.01 to 20 wt. % sodium sulphate, potassium sulphate or mixtures thereof is desensitized and therefore safe in that on drying the additives of the suspension coat the solid peroxide particles. U.S. Pat. No. 4,790,949 claims a storage resistant pourable-to-pasty aqueous bleaching agent suspension having a pH between 1 and 6 containing an aqueous carrier liquid, a particulate substantially water-insoluble peroxy carboxylic acid, an acidifying agent, 0.1 to 7% colloidal silicic acid and a hydrate-forming neutral salt which desensitizes carboxylic acids in an amount of 10–40% by weight of the peroxy carboxylic acid used. Sodium sulphate is the particularly preferred hydrate-forming neutral salt. U.S. Pat. No. 4,790,949 also discloses the use of additional desensitizing agents and in particular boric acid.

As mentioned above, European Patent Application No. 283 792 discloses a storage-stable, pourable aqueous bleach suspension comprising, inter alia, a particulate water-insoluble peroxy carboxylic acid and a hydrate-forming phlegmatising neutral salt such as $Na_2SO_4$. In European Patent Application 240 481 stable liquid bleach compositions comprising certain water insoluble diperoxy acid particles, $C_{11}$–$C_{13}$ linear alkyl benzene sulphonate surfactant, cumene sulphonate, magnesium sulphate, and sodium or potassium sulphate. The fact that magnesium sulphate, sodium sulphate and potassium sulphate are effective exotherm control agents is disclosed. U.S. Pat. No. 4,100,095 claims a dry granular bleach consisting essentially of boric acid and certain peroxy acid compounds. Boric acid is discussed in the specification as an exotherm control agent. "Exotherm control agents" have met ignition, heating (oven) and hot-wire tests. It has been surprisingly found that the addition of polyethylene glycol to suspensions of peroxy acids reduces the likelihood of combustion and/or explosion of such suspensions.

It should be particularly noted that GB 1 387 167 discloses a solid particulate bleaching agent comprised of a peroxy substance (such as a peroxy acid) which has been substantially surrounded by a water-impermeable material having a melting point between 30° and 95° C. and further surrounded by a water-soluble inorganic hydrate salt. Such double-coated particles may also be sprayed with polyethylene glycol. The specification of GB 1 387 167 suggests the polyethylene glycol spraying to make the salt coating more resistant to abrasion, to de-dust the particles and to control the rate of particle solution. GB 1 387 167 mentions desensitizing the peroxide only in the context of the water-impermeable material.

Further, a flame resistant peroxide composition consisting essentially of at least a minimum amount of water necessary to create flame resistance, certain saturated hydrocarbon ketone peroxides and sufficient water-soluble polyalkylene glycol to form a homogeneous condition between the peroxide and water is claimed in U.S. Pat. No. 3,507,800. According to the disclosure in U.S. Pat. No. 3,507,800, flame resistance is created by the presence of water and the polyethylene glycol is added as a mutual solvent for the peroxide and water.

It should also be noted that EP 167 375 discloses a stable peroxy acid bleaching composition comprising a surface active peroxy acid and at least one surfactant which forms a mixed micelle in aqueous solutions with said peroxy acid. Suitable surfactants are selected from anionic, nonionic, amphoteric and zwitterionic surfactants. Preferred are fatty acids or salts thereof. Among the numerous surfactants listed polyoxyethylenes are mentioned.

Japanese Patent Application 7114648 discloses the use of nonionic surfactant(s), polyoxyethylene glycol and/or polyoxypropylene glycol with tertbutylhydroperoxide in water to form a "homogeneous mixed liquid". Di-tert-butyl peroxide may also be present.

It is, however, a continuing problem to provide aqueous peroxide suspensions with an improved safety profile. For example, boric acid has a negative effect on the chemical stability of peroxide suspensions. Additionally, boric acid is undesirable since aqueous suspensions have an inherent maximum solid content and the presence of boric acid reduces the amount of solid peroxy acid which may be placed in the suspension.

Further, peroxy acids, and suspensions of such acids, are highly reactive and thus have a strong propensity for combustion and/or explosion. This raises transportation problems in that, for safety reasons, the amount of peroxy acid transported in a bulk container must be limited.

SUMMARY OF THE INVENTION

It has been surprisingly found that an aqueous peroxide composition with an improved safety profile may be formed comprising a solid substantially water-insoluble organic peroxy acid stably suspended in an aqueous medium, wherein the aqueous medium also comprises an effective amount of a safety booster selected from the group consisting of triethylene glycol, polyethylene glycol, and mixtures thereof.

DETAILED DESCRIPTION OF THE INVENTION

The solid substantially water-insoluble organic peroxy acids which may be used in the aqueous peroxide compositions of the current invention are generally known in the art. As nonlimiting examples, the solid organic peroxy acids disclosed in European Application No. 85201382.0 and U.S. Pat. Nos. 4,758,369, 4,642,198, 4,681,592, 4,634,551, and 3,996,152 may be used and are all herein incorporated by reference. The most preferred organic peroxy acids which may be used in the compositions of the current invention are (1) diperoxy acids, such as 1,12-diperoxydodecanedioic acid ("DPDA"), diperazelaic acid and 1,13-diperoxytridecanedioic acid, (2) peroxy acids which have a polar amide link in the hydrocarbon chain, such as N-decanoyl-6-aminoperoxyhexanoic acid, N-dodecanoyl-6-aminoperoxyhexanoic acid, 4-nonylamino-4-oxoperoxybutyric acid and 6-nonylamino-6-oxoperoxyhexanoic acid, and (3) alkyl sulphonyl peroxy carboxylic acids, such as hexyl sulphonyl perpropionic acid, heptyl sulphonyl perpropionic acid, octylsulphonyl perpropionic acid, nonylsulphonyl perpropionic acid, and decylsulphonyl perpropionic acid. Methods for preparing such preferred peroxy acids are known in the art and in particular from the above-cited references. Optionally, the solid organic peroxy acid may be coated with a water impermeable material, such as the fatty acids, lauric acid, myristric acid and mixtures thereof, as known from European Patent Application 254 331. The amount of peroxy acid in the current aqueous peroxide compositions depends on criteria such as the peroxy acid used, the active oxygen ("A.O.") content of the peroxy acid, the intended use of the aqueous peroxide composition, and the stage of preparation of the aqueous peroxide composition. (For example, compositions for bulk transportation will probably have a high concentration of peroxy acid, e.g. about 25 to about 45 wt. % whereas formulations for consumer use will have a substantially reduced peroxy acid concentration, e g. about 4 to about 6 wt. %.).

The additives used to prepare the aqueous peroxide compositions with improved safety profile according to the present invention may be further described as follows.

Polyethylene glycol (also referred to as polyoxyethylene, polyglycol or polyetherglycol), hereinafter sometimes referred to as PEG, is available in various numbered grades which reflect the approximate molecular weight of the polymer. PEG may also be classified by its degree of polymerization. A grade 200 PEG is equivalent to PEG-4 (PEG having 4 degrees of polymerization). A grade 600 PEG is equivalent to PEG-12. For the current invention, PEG-4, PEG-8, and PEG-12 are preferred ignition-safe additives with PEG-4 being the most preferred. PEG's may be purchased under the trademark "Carbowax". Triethylene glycol ("TEG") may also be employed in suspensions of the current invention, either alone or in combination with PEG.

It is further remarked that diglyceride may be added as a bleaching adjuvant to the peroxide composition of the present invention.

Preferably, the safety of the aqueous peroxide compositions is improved to such an extent as to provide suspensions which are considered ignition-safe upon drying.

The amount of PEG necessary to provide suspensions which are ignition-safe upon drying depends on various criteria, such as the peroxy acid used, the active oxygen content of the peroxy acid and the concentration of the peroxy acid. As demonstrated by the examples which follow, aqueous suspensions of about 22 to 27 wt. % DPDA are rendered ignition-safe upon drying with the use of about 19 wt. % PEG-12, about 17 wt. % PEG-8 or about 14 wt. % PEG-4. Such suspensions also have substantially increased safety as suspensions, allowing for bulk storage and transportation of greater volumes of suspension and more concentrated suspensions. Aqueous suspensions of about 6 wt. % DPDA are rendered ignition-safe upon drying with the use of about 4 wt. % PEG-12 or 3 wt. % PEG-4.

The amount of TEG necessary to provide suspensions which are ignition-safe upon drying also depends on various criteria, such as the peroxy acid used, the active oxygen content of the peroxy acid and the peroxy acid concentration. As demonstrated by the examples which follow, aqueous suspensions of about 25 wt. % DPDA are rendered ignition-safe upon drying with about 10 wt. % TEG. Suspensions of about 6 wt. % DPDA are ignition-safe at about 2 wt. % TEG.

In general it may be recognized that in the preferred aqueous peroxide compositions according to the present invention, which are ignition-safe upon drying, the weight percentage of the additive is at least about half the weight percentage of peroxy acid.

The aqueous peroxide compositions of the present invention are very suited to be used within the framework of non-prepublished EP 347 988, which relates to pourable aqueous bleaching compositions comprising solid organic peroxy acids and at least two polymers, one being a natural gum and the other being polyvinyl alcohol, a cellulose derivative, or a mixture of the two.

The current invention's aqueous peroxide compositions with improved safety profile are further illustrated by the following non-limiting examples.

EXAMPLE 1

An aqueous suspension comprised of 27 wt. % 1,12-diperoxydodecanedioc acid ("DPDA"), 3 wt. % $Na_2SO_4$ and the remainder water was prepared. PEG-12, PEG-8, PEG-4 and TEG were separately added in varying concentrations to 40 gram samples of this suspension as further detailed in Table 1. The test suspensions were then individually placed in flat porcelain dishes (surface area 38 $cm^2$) and left to dry at ambient temperature and a humidity of 50%. After 3 weeks the suspensions had become dry and the residues were tested for ignitability by the standard gas flame test. The results of the gas flame test are provided in Table 1. Suspensions having ignition times greater than 20 seconds are considered ignition-safe by those skilled in the art.

EXAMPLE COMPARING SAFETY BOOSTERS

In the art it is generally recognized that a safety improvement of dried peroxide suspensions may be reached by the addition of a substance exhibiting hygroscopic character and a high flash point. For comparison in this respect DPDA samples of the above type were also provided with such a compound having the potential as a safety booster, viz. diglycerine. The results are also listed in Table 1 (test suspensions C1 and C2). It should be noted that the addition of diglycerine does lead to improved bleaching characteristics.

The relevant properties of additives used in Example 1 and this Example Comparing Safety Boosters are as follows:

| Safety Boosters | | | |
|---|---|---|---|
| Substance: | PEG-4 | TEG | Diglycerine |
| Hygroscopicity: | 11% | 18% | 18% |
| Flash point: | 180° C. | 170° C. | 243° C. |

Considering the results outlined in Table 1 in view of the above comparison of the additives used shows that the good performance of the suspensions according to the present invention could not have been foreseen by the artisan.

TABLE 1

| Gas Flame Test Results of Peroxy Acid Suspensions Containing PEG or TEG | | | | |
|---|---|---|---|---|
| Test Suspension | Additive | Amount of Additive (Grams) | Residue (Grams) | Time to Ignite (Seconds) |
| 1 | PEG-4 | 6.13 | 18.6 | 20+ |
| 2 | PEG-4 | 7.0 | 19.5 | 20+ |
| 3 | PEG-4 | 8.0 | 20.5 | 20+ |
| 4 | PEG-8 | 7.0 | 19.5 | 19 |
| 5 | PEG-8 | 8.0 | 20.5 | 20+ |
| 6 | PEG-12 | 7.3 | 19.5 | 14 |
| 7 | PEG-12 | 8.1 | 20.5 | 20+ |
| 8 | TEG | 6.0 | 19.4 | 20+ |
| 9 | TEG | 5.0 | 18.4 | 20+ |
| 10 | TEG | 4.0 | 17.3 | 15 |
| C1 | diglycerine | 7.0 | 21.2 | 6 |
| C2 | diglycerine | 8.0 | 22.3 | 8 |

EXAMPLE 2

In order to be useful as a bleaching, cleaning, detergent and/or disinfecting agent, the aqueous peroxide compositions of the current invention should be chemically and physically stable. Chemical stability is determined by the residual peroxy acid activity. The physical stability is determined by the suspension's phase behavior, that is, the one-phase suspension should not separate into two or more phases over time. A peroxy acid formulation having the following composition was prepared.

| | |
|---|---|
| PEG-12 | 3 wt. % |
| DPDA | 6 wt. % |
| Linear alkyl benzene sulphonate | 5 wt. % |
| $Na_2SO_4$ | 10 wt. % |
| Xanthan gum | 0.3 wt. % |
| Chelating Agent (Dequest 2010) | 0.05 wt. % |

The test suspension was held at 40° C. for 8 weeks. The suspension remained a single phase during the entire 8 week period. After 4 weeks at 40° C. the residual DPDA activity of the suspension was 70%. After 8 weeks at 40° C. the residual DPDA activity was 50%. The pH of the initial suspension and of the suspension after 8 weeks at 40° C. was 3.5.

EXAMPLE 3

The bleaching effectiveness of aqueous peroxy acid suspensions comprising polyethylene glycol was investigated using test suspensions 13 through 16. The compositions of the test suspensions are described in Table 2. In Table 2, %=wt. %. By measuring the reflectance of stained fabric treated with the various suspensions, the bleaching effectiveness of these suspensions can be demonstrated. The results of the reflectance measurements are provided in Table 2.

For each stain in Table 2, four 6×6 cm swatches were prepared. Each swatch was then wetted with 1 gram of a test suspension so that each suspension was separately tested on each stain. The wetted swatches were stored for 30 minutes then rinsed and dried. The reflectance of each dried swatch was measured by a Minolta Chromameter CR-110. The results are contained in Table 2.

TABLE 2

| Bleaching Effectiveness of Peroxy Acid Suspensions Containing PEG | | | | |
|---|---|---|---|---|
| Test Suspension | 13 | 14 | 15 | 16 |
| DPDA | 25.5% | 23.0% | 21.7% | 20.4% |
| PEG-4 | — | 10% | 15% | 20% |
| Xanthan Gum | 0.2% | 0.2% | 0.2% | 0.2% |
| Hydroxyethylcellulose | 0.2% | 0.2% | 0.2% | 0.2% |
| $Na_2SO_4$ | 3.0% | 2.7% | 2.6% | 2.7% |
| Water | Balance | Balance | Balance | Balance |
| pH | 3.9% | 3.7% | 4.1% | 4.2% |
| Reflectance | | | | |
| Tea Stain | 47 | 53 | 57 | 59 |
| Red Wine Stain | 59 | 69 | 70 | 70 |
| Berry Stain | 57 | 62 | 61 | 64 |

EXAMPLE 4

This example demonstrates that the addition of PEG to peroxy acid suspensions reduces the likelihood of explosion and/or combustion and, consequently, allows storage and transportation of larger volumes of peroxy acids and/or more concentrated suspensions of such acids.

The Pressure Vessel Test ("PVT") is a standard test for determining the quantity of peroxy acid which may be transported in one container. The PVT is described in detail in Vervoer Gevaarlijke stoffen, Dec. 23, 1980, Aanhangsel A1 bij-bijlage A, pp. 907,908,915: Staatsuitgeverij. In sum, the test employs a pressure vessel fitted with a bursting disk set to 6 bar. A side wall of the vessel is fitted with a variable diameter blow-off opening. In operation, 10 grammes of the material to be tested (in this case, peroxy acid suspension described in Table 3) are placed in the pressure vessel. The vessel is then heated with a standardized gas flame. If the bursting disk remains intact, another 10 grammes of test material are charged to the pressure vessel, the size of the blow-off opening is reduced, and the heating is repeated. This process is followed until the bursting disk is just intact, that is, until the next reduction in the blow-off opening would cause rupture of the bursting disk. Naturally, the smaller the acceptable blow-off opening, the safer the formulation. The acceptable blow-off opening (in mm) is the PVT value. For example, a low PVT value will allow single container transportation of at least 450 1 of DPDA; and a medium PVT value limits such transport of DPDA to 50 kg.

Table 3 contains the compositions of three peroxy acid suspensions and the results of PVT's on such compositions. In Table 3, %=wt. %.

TABLE 3

Safety of Peroxy Acid Suspensions Containing PEG

| Test Suspension | 17 | 18 | 19 |
|---|---|---|---|
| DPDA | 26.1% | 26.1% | 25.5% |
| PEG-4 | none | none | 15.0% |
| Chelating Agent (Dequest 2010) | none | 0.05% | 0.05% |
| Xanthan Gum | 0.2% | 0.2% | 0.2% |
| Hydroxyethylcellulose | 0.2% | 0.2% | 0.2% |
| $Na_2SO_4$ | 3.0% | 3.0% | 1.0% |
| Water | Balance | Balance | Balance |
| Pressure Vessel Test Results | | | |
| Blow-off Opening Diameter (mm) | | | |
| 1 | – | N/T | N/T |
| 1.5 | N/T | N/T | + |
| 2 | – | N/T | – |
| 3 | – | + | N/T |
| 5 | N/T | + | N/T |
| 7 | N/T | – | N/T |
| Safety Risk | Low | Medium | Low |

In Table 3, a "–" indicates that the bursting disk did not rupture, a "+" indicates that a rupture occurred and "N/T" indicates no test.

As can be seen from Table 3, the addition of the chelating agent Dequest 2010 may substantially increase the potential safety hazard of peroxy acid suspensions. Such chelating agents are usually necessary to remove metallic ions and thus enhance the storage stability of peroxy acid suspensions. However, surprisingly, the addition of PEG to such suspensions reduces the safety hazard of such suspensions to a point that bulk transport of the suspensions may be substantially increased.

EXAMPLE 5

This Example shows the applicability of the aqueous peroxide compositions of the present invention in pourable aqueous bleaching compositions according to EP 347 988.

Prepared were suspensions 5a, 5b and 5c having the following composition:

| | |
|---|---|
| DPDA | 25 wt. % |
| TEG | 10 wt. % |
| $Na_2SO_4$ | 1 wt. % |
| Hydroxy ethyl cellulose | 0.2 wt. % |
| Dequest 201 | 0.5 wt. % |
| Natural gum | 0.2 wt. % |
| Initial pH | 3.5 |

In suspension 5a the natural gum is Xanthan gum, in 5b it is Alpha-flo (trademark of Ibis corporation) and in 5c it is Welan gum, a type of gum commercialized by Kelco.

The suspensions were stored at 40° C. for 8 weeks and at room temperature for 26 weeks. They remained single phase during the whole of the two storage periods and showed the required stability. For these suspensions the following data can be given:

| Suspension: | 5a | 5b | 5c |
|---|---|---|---|
| active oxygen (%) | 2.95 | 2.85 | 2.87 |
| $H_2O_2$ (%) | 0.32 | 0.33 | 0.34 |
| ph | | | |
| (26 wk. amb. temp.) | 3.0 | 3.2 | 3.1 |
| (8 wk. 40° C.) | 3.0 | 3.0 | 3.0 |
| DPDA-residue (%) | | | |
| (26 wk. amb. temp.) | 97 | 93 | 96 |
| (8 wk. 40° C.) | 82 | 80 | 81 |

I claim:

1. An aqueous peroxide composition with improved safety profile comprising 25% –45% by weight of a solid, substantially water-insoluble organic peroxy acid stably suspended in an aqueous medium, wherein said aqueous medium comprises a safety booster selected from the group consisting of triethylene glycol, polyethylene glycol and mixtures thereof, said safety booster added in an amount which is at least one-half the weight percent of peroxy acid present in said aqueous medium.

2. An aqueous peroxide composition with improved safety profile comprising a solid, substantially water-insoluble organic peroxy acid stably suspended in an aqueous medium, wherein the aqueous medium is comprised of water; a safety booster in an amount effective to improve the safety profile of said composition, said safety booster selected from the group consisting of triethylene glycol, polyethylene glycol, and mixtures thereof; and diglycerine in an amount effective to improve the bleaching characteristics of said composition.

3. The composition of claim 2 wherein the organic peroxy acid is a diperoxy acid.

4. The composition of claim 3 wherein the diperoxy acid is selected from the group consisting of 1,12 diperoxydodecanedionic acid, diperazelaic acid and 1,13 diperoxytridecanedioic acid.

5. The composition of claim 2 wherein the organic peroxy acid is a amido peroxy acid.

6. The composition of claim 5 wherein said amido peroxy acid is selected from the group consisting of N-decanoyl-6-aminoperoxyhexanoic acid, N-dodecanoyl-6-aminoperoxyhexanoic acid, 4-nonylamino-4-oxoperoxybutyric acid and 6-nonylamino-6-oxoperoxyhexanoic acid.

7. The composition of claim 2 wherein the organic peroxy acid is a alkyl sulphonyl peroxy carboxylic acid.

8. The composition of claim 7 wherein the alkyl sulphonyl peroxy carboxylic acid is selected from the group consisting of hexylsulphonyl perpropionic acid, heptylsulphonyl perpropionic acid, octylsulpbonyl perpropionic acid, nonylsulphonyl perpropionic acid and decylsulphonyl perpropionic acid.

9. The composition of claim 1 wherein the organic peroxy acid is a diperoxy acid.

10. The composition of claim 9 wherein the diperoxy acid is selected from the group consisting of 1,12 diperoxydodecanedionic acid, diperazelaic acid and 1,13 diperoxytridecanedioic acid.

11. The composition of claim 1 wherein the organic peroxy acid is a amido peroxy acid.

12. The composition of claim 11 wherein said amido peroxy acid is selected from the group consisting of N-decanoyl-6-aminoperoxyhexanoic acid, N-dodecanoyl-6-aminoperoxyhexanoic acid, 4-nonylamino-4-oxoperoxybutyric acid and 6-nonylamino-6-oxoperoxyhexanoic acid.

13. The composition of claim 1 wherein the organic peroxy acid is a alkyl sulphonyl peroxy carboxylic acid.

14. The composition of claim 13 wherein the alkyl sulphonyl peroxy carboxylic acid is selected from the group consisting of hexylsulphonyl perpropionic acid, heptylsulphonyl perpropionic acid, octylsulphonyl perpropionic acid, nonylsulphonyl perpropionic acid and decylsulphonyl perpropionic acid.

* * * * *